US010722047B2

(12) United States Patent
Gallina

(10) Patent No.: US 10,722,047 B2
(45) Date of Patent: Jul. 28, 2020

(54) CRIBS

(71) Applicant: Artsana S.p.A., Grandate (IT)

(72) Inventor: Erica Gallina, Anzio (IT)

(73) Assignee: ARTSANA S.P.A., Grandate (CO) (IT)

( * ) Notice: Subject to any disclaimer, the term of this patent is extended or adjusted under 35 U.S.C. 154(b) by 200 days.

(21) Appl. No.: 15/878,971

(22) Filed: Jan. 24, 2018

(65) Prior Publication Data

US 2018/0206652 A1 Jul. 26, 2018

(30) Foreign Application Priority Data

Jan. 25, 2017 (IT) ..... 102017000008138

(51) Int. Cl.

| | |
|---|---|
| ***A47D 9/04*** | (2006.01) |
| ***A47D 7/02*** | (2006.01) |
| ***A47D 9/00*** | (2006.01) |
| ***A47D 7/04*** | (2006.01) |

(52) U.S. Cl.

CPC ..... *A47D 9/04* (2013.01); *A47D 7/02* (2013.01); *A47D 7/04* (2013.01); *A47D 9/00* (2013.01)

(58) Field of Classification Search

None

See application file for complete search history.

(56) References Cited

U.S. PATENT DOCUMENTS

| | | | | |
|---|---|---|---|---|
| 3,274,676 | A | 9/1966 | Gallagher et al. | |
| 6,113,325 | A * | 9/2000 | Craft | A61G 3/0808 296/65.04 |
| 2002/0152550 | A1 * | 10/2002 | Tharalson | A47D 5/00 5/95 |
| 2005/0034232 | A1 | 2/2005 | Martin | |

(Continued)

FOREIGN PATENT DOCUMENTS

| | | | |
|---|---|---|---|
| DE | 20307464 | U1 | 5/2004 |
| EP | 2976973 | A1 | 1/2016 |

(Continued)

OTHER PUBLICATIONS

Italian Search Report dated Oct. 16, 2017, in Italian Application No. 201700008138, 7 pages.

(Continued)

*Primary Examiner* — David R Hare
*Assistant Examiner* — Adam C Ortiz
(74) *Attorney, Agent, or Firm* — MH2 Technology Law Group LLP

(57) ABSTRACT

A baby crib may include: a frame including an upper portion and a lower portion connected together; a plurality of peripheral walls made of flexible material and secured to the frame; a bottom secured to the frame at the lower portion of the frame and surrounded by the peripheral walls; at least one of the peripheral walls having variable height; a support structure configured to support the frame and configured to increase and/or decrease a height of the bottom; and elastic return members, fixed to the lower portion of the frame, that (Continued)

are configured to be fixed to a bed to push or pull the frame against the bed. The upper portion, the lower portion, and the elastic return members may be rigidly movable jointly with each other and with the bottom when the height of the bottom is increased and/or decreased.

20 Claims, 5 Drawing Sheets

(56) References Cited

U.S. PATENT DOCUMENTS

| | | | | |
|---|---|---|---|---|
| 2010/0115695 | A1* | 5/2010 | White | A61G 7/1015 5/81.1 R |
| 2011/0258776 | A1* | 10/2011 | Schwartz | A47D 7/02 5/100 |
| 2014/0101847 | A1 | 4/2014 | Von Rohrscheidt et al. | |
| 2014/0208503 | A1 | 7/2014 | Horst et al. | |

FOREIGN PATENT DOCUMENTS

| | | | |
|---|---|---|---|
| GB | 2423243 | A | 8/2006 |
| WO | 2016/012955 | A1 | 1/2016 |

OTHER PUBLICATIONS

Italian Search Report dated Oct. 23, 2017, in Italian Application No. 201700008130, 7 pages.
Garcia, "Physics of Balance & Weight Shift," pp. 1-22 (Jan. 2011).
Non-final Office Action, U.S. Appl. No. 15/878,864, dated Oct. 31, 2019.

* cited by examiner

CRIBS

CROSS-REFERENCE TO RELATED APPLICATION(S)

This application claims priority under 35 U.S.C. § 119 from Italian Patent Application No. 102017000008138, filed on Jan. 25, 2017, in the Italian Patent and Trademark Office ("IPTO"), the entire contents of which are incorporated herein by reference.

The present invention relates to a baby crib. Namely, the crib of the present invention is designed to be placed adjacent to an adult bed, particularly the bed of the mother or the person who cares for the baby at night. Such adjacent position particularly requires the possibility of adapting the height of the crib to the height of the bed, thereby creating a seamless, step-free surface.

More in detail, a prior art crib comprises a support frame, preferably formed with tubular, rod-like elements. The crib also comprises a plurality of perimeter walls, which are formed from flexible material and are attached to the frame. The crib further comprises a bottom wall, also attached to the frame, with a mattress for supporting a baby lying thereupon.

One of the aforementioned perimeter walls is configured to be able to be opened. This perimeter wall defines a frame side that is designed to be adjacent to the bed. Particularly, this wall can be detached from the adjacent walls and overturned on the wall itself, to form an opening through which the person who cares for the baby may access the baby without rising from his/her bed.

In the prior art, the crib is attached to the bed using one or more belts, which are fastened to the bed and fixed to the crib at an attachment area and are later manually tensioned using an adjustment device.

A problem arises in that, in spite of all the efforts for ensuring that the crib is positioned next to the adult bed with as small a gap as possible therebetween, no one can exclude that, once the wall portion has been overturned, a temporarily unattended baby may come out of the crib and fall within the gap, as small as it is, between the crib and the side of the bed of the adult who is taking care of him/her.

In addition, if the crib is displaced once the belts have been fixed, the gap between the crib and the bed may become wider, thereby increasing the hazards for the baby.

SUMMARY OF THE INVENTION

In this context, the technical purpose of the present invention is to provide a baby crib that can obviate the aforementioned prior art drawbacks.

A further object of the present invention is to provide a baby crib that can increase the safety level for the baby, by particularly improving adhesion of the crib to the bed.

The aforementioned technical purpose and objects are substantially fulfilled by a baby crib that comprises the technical features as disclosed in one or more of the accompanying claims.

Namely, a baby crib of the present invention comprises a frame and a plurality of peripheral walls made of a flexible material and secured to the frame. At least one of the peripheral walls has a variable height. The crib further comprises a bottom, which is secured to the frame, The crib comprises a support structure for the frame. Such support structure is configured to increase and/or decrease the height of the bottom.

The crib also comprises elastic return members, which are fixed to the frame and can be fixed to a bed for pushing the frame against the bed.

The crib solves the aforementioned technical problem by ensuring full adhesion between the frame and the bed, due to the addition of the elastic return members. Furthermore, this position is also restored if the crib is inadvertently displaced.

LIST OF FIGURES

Further features and advantages of the present invention will result more clearly from the illustrative, non-limiting description of a preferred, non-exclusive embodiment of a baby crib as shown in the annexed drawings, in which.

DETAILED DESCRIPTION

Referring to the annexed figures, numeral 1 designates a baby crib of the present invention.

The crib 1 has a front side 1*a*. As used herein, the term "front side" is intended to designate the side of the crib 1 that is designed to be placed adjacent to a bed. Namely, the front side la may be opened in various manners, which may be selected from those known to the skilled person or from those disclosed in other patent applications by the applicant hereof.

Figure 1:
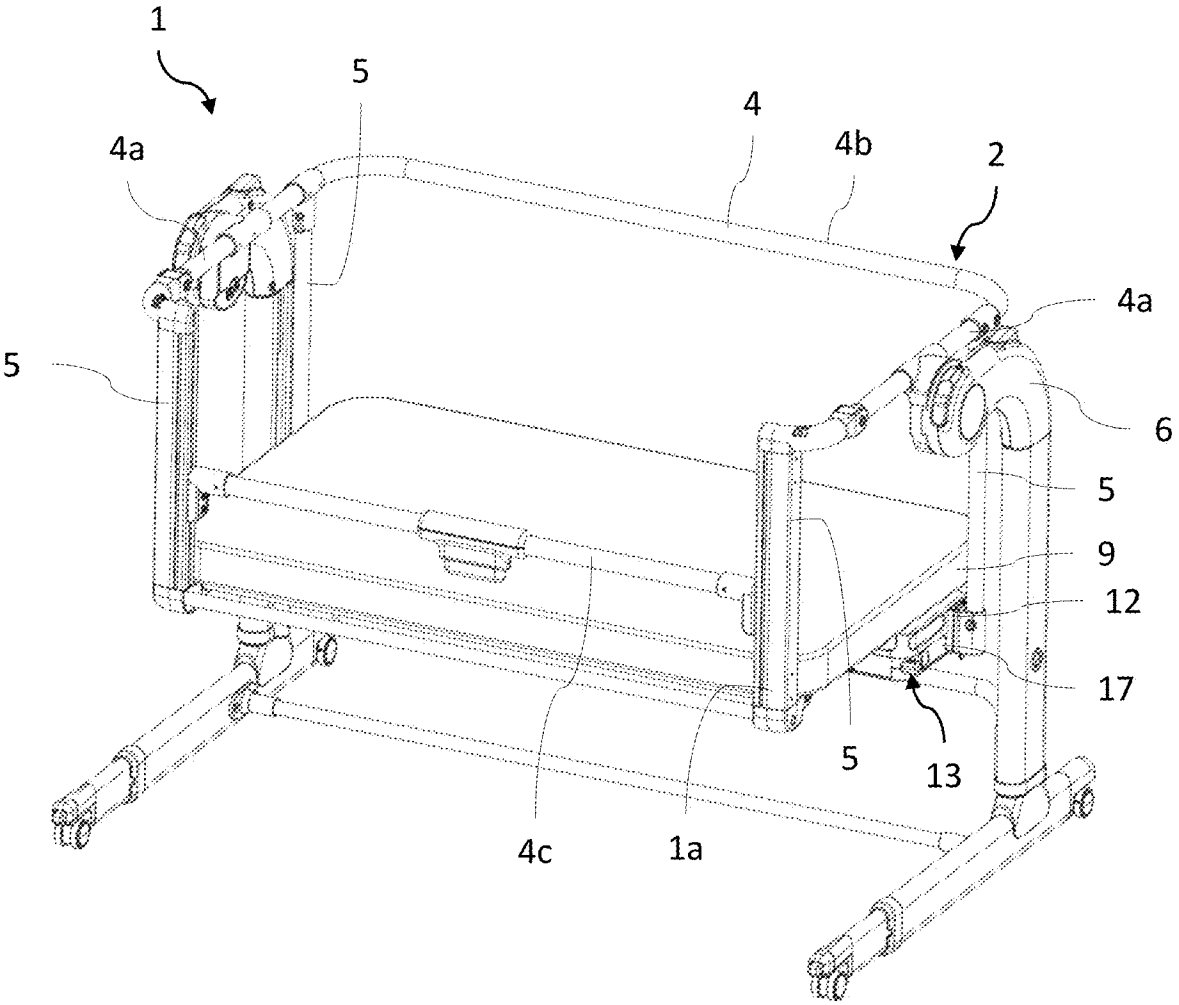
FIG. 1 is a perspective view of a baby crib of the present invention, with certain parts omitted to better show other parts.
Figure 2:
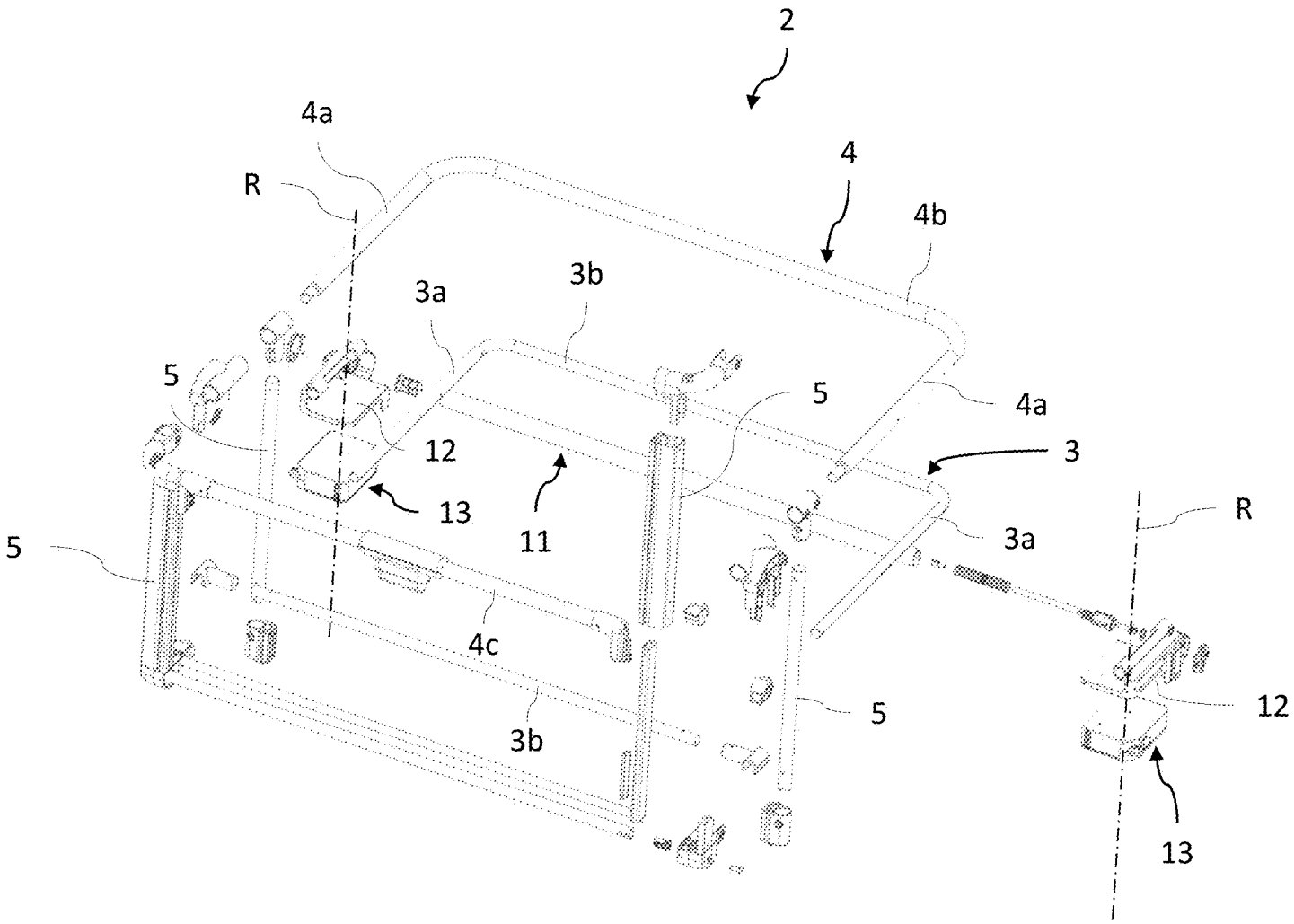
FIG. 2 is an exploded perspective view of the baby crib of FIG. 1.

The crib 1 comprises a frame 2. Referring to FIG. 1, it will be appreciated that the crib 1 is defined by a plurality of rod-like elements, preferably of tubular type. The frame 2 substantially has the shape of a parallelepiped, and is supported by a support structure 6 that rests upon the floor. The support structure 6 may be of any type, as long as it can adjust the height of the frame 2 from the ground to adapt it to the height of the bed.

The crib 1 comprises a plurality of perimeter walls 7, which are formed from flexible material and are secured to the frame 2. A bottom 8, also connected to the frame 2 and particularly equipped with a mattress 9, is designed to receive a baby.

It will be appreciated that at least one of the perimeter walls 7 has a variable height or another equivalent mechanism to open the front side l*a* of the crib 1.

More particularly, the frame 2 comprises a lower portion 3 and an upper portion 4. The lower 3 and upper 4 portions are connected by a plurality of vertical posts 5. Namely, the frame 2 comprises four posts 5, whereof two are placed at the front side 1*a* of the crib 1.

More in detail, the lower portion 3 has a substantially rectangular plan shape. The lower portion 3 comprises a pair of opposite and particularly parallel first sides 3*a*. The lower portion 3 also comprises a pair of opposite and particularly parallel second sides 3*b*. Each first side 3*a* is connected to both second sides 3*b*. It will be appreciated that the second sides 3*b* are longer than the first sides 3*a*. The front side 1*a* of the crib 1 is defined at one of the aforementioned first sides 3*a*.

Like the lower portion 3, the upper portion 4 has a pair of opposite first sides 4*a*. A second side 4*b* connects the two ends of the first sides 4*a*, and is perpendicular thereto. The first sides 4*a* and the second side 4*b* are preferably formed of one piece, and have a "C" shape. The support structure 6 of the frame 2 is connected to the upper portion 4 of the frame 2, particularly the first sides 4*a* as shown in FIG. 1.

The upper portion 4 further comprises a moving side 4*c*, disposed transverse, and particularly perpendicular to the first sides 4*a*. Therefore, the moving side 4*c* is disposed parallel to the second side 4*b* of the upper portion 4. More particularly, the moving side 4*c* of the upper portion 4 is disposed at the front side 1*a* of the crib 1 and defines the openable part of the frame 2. The mechanism for opening/closing and locking/unlocking the moving side 4*c* may be of any of the types known by the skilled persons, or may be of novel type, as disclosed in a different patent application by the applicant hereof.

Namely, in the crib 1 of the present patent application, the moving side 4*c* slides along a pair of the aforementioned posts 5. One of the perimeter walls 7 is defined by a flexible element 10 which is connected to the moving side 4*c*. The flexible element 10 is wound around a winding reel 11 which is disposed under the bottom 8 parallel to the second sides 3*b* of the lower portion 3.

More in detail, the frame 2 comprises at least one connection element 12 attached to the lower portion. Namely, the frame 2 comprises a pair of connection elements 12, each attached to a respective first side 3*a* of the lower portion 3 of the frame 2. Advantageously, the winding reel 11 is rotatably attached to the connection elements 12, and is particularly disposed between the connection elements 12.

Figure 3:
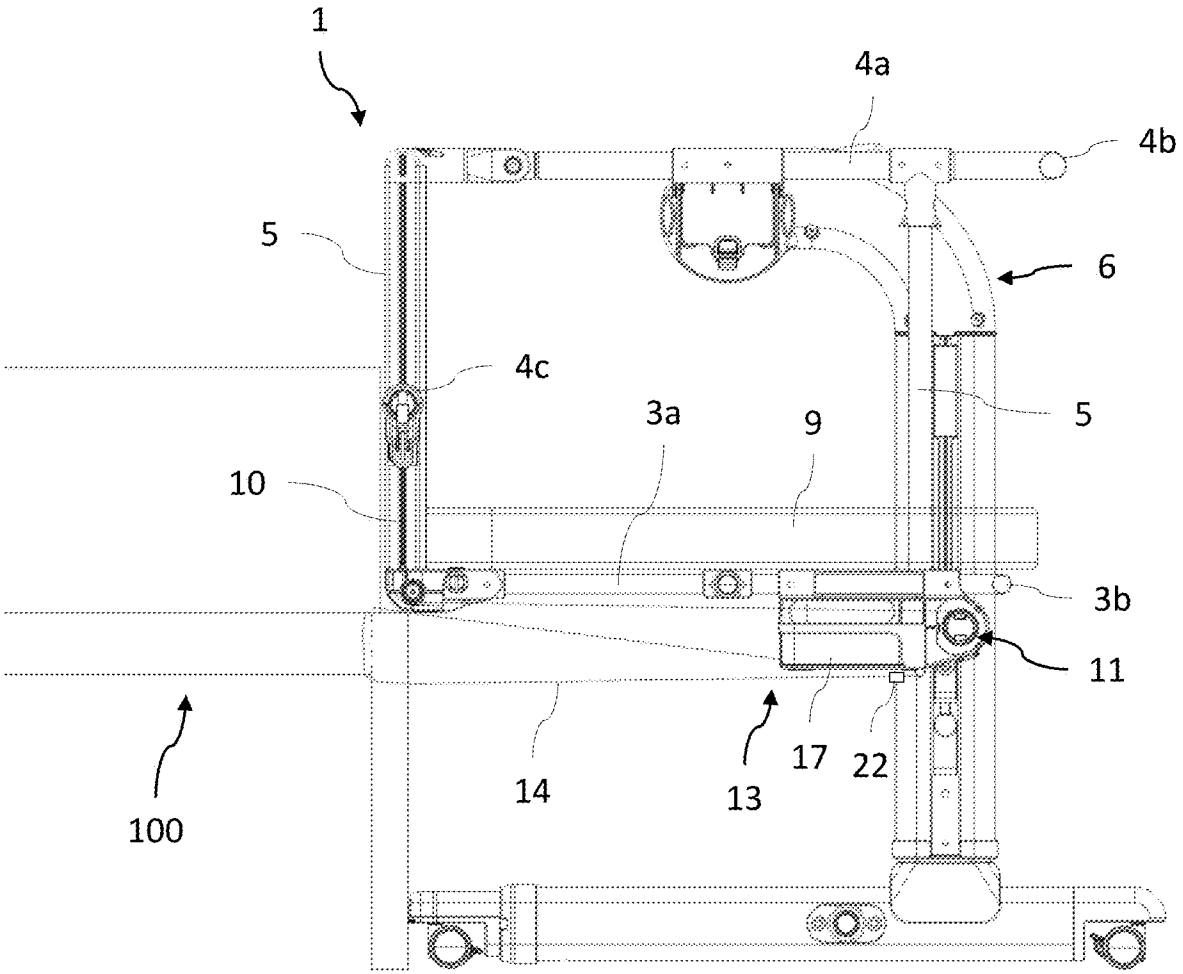
FIG. 3 is a side view of the crib of FIGS. 1 and 2, placed adjacent to a bed.

Referring to FIG. 3, the crib 1 comprises elastic return members 13, which are fixed to the frame 2. These elastic return members 13 are also adapted to be secured to a bed 100 to push the frame 2 against such bed 100. Namely, the elastic return members 13 comprise at least one winding belt 14. Such a winding belt 14 is attached to the frame 2, and is particularly placed below the bottom 8.

More in detail, the elastic return members 13 comprise at least one roller 15. Namely, the elastic return members 13 comprise a pair of rollers and a pair of winding belts 14. Each winding belt 14 is adapted to be wound around a respective roller 15. The rollers 15 are rotatably connected to the frame 2, and are particularly located at a respective first side 3*a* of the lower portion 3 of the frame 2.

Figure 4:
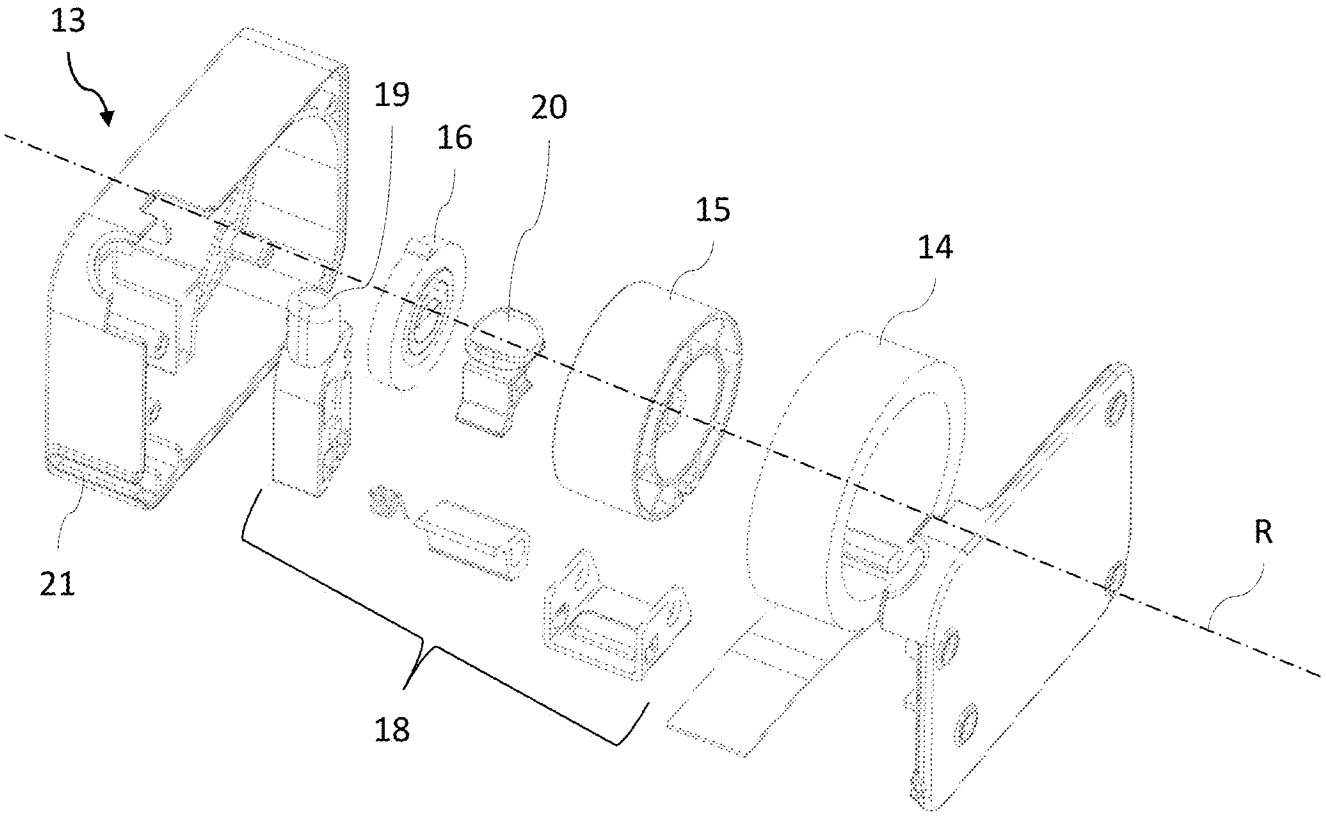
FIG. 4 is an exploded perspective view of a detail of the crib of FIGS. 1 and 2.
Figure 5:
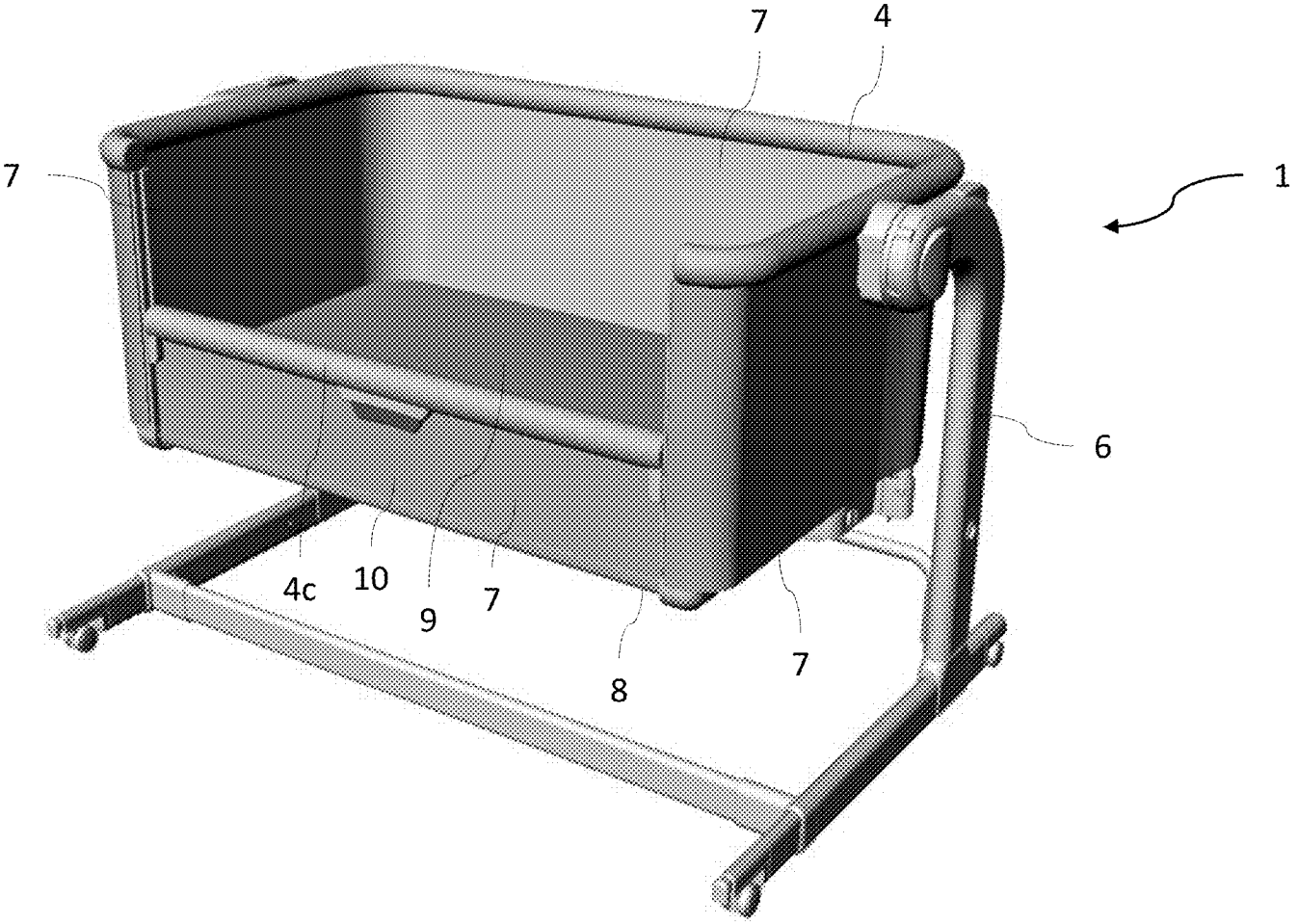
FIG. 5 is a perspective view of crib of FIGS. 1 and 2.

A spring 16 is connected to each roller 15 and is configured to apply an elastic torque to the roller 15. In the embodiment as shown in FIG. 4, the spring 16 is a torsion spring, is housed within the roller 15 and is particularly coaxial therewith.

It shall be noted that each roller 15 has an axis of rotation "R" which, with the crib 1 in use, is substantially vertically oriented. More in detail, it will be appreciated that each roller 15 is rotatably fixed to a respective connection element 12, and is connected to the frame 2 via such connection element 12.

More in detail, each roller 15 is placed inside a box-like body 17. Such box-like body 17 has a slot 21 for the belt 14 to extend out of it. Lock/unlock members 18 for locking/unlocking the belt 14 are also housed within the box-like body 17 and comprise a lock button 19 and an unlock button 20, which partially project out of the box-like body 17. These buttons 19, 20 may be accessed by a user, for operability of the lock/unlock members 18. The mechanism to operate the lock/unlock members 18 is known in the art and will not be further described herein.

The elastic return members 13 also comprise a buckle 22 for locking/unlocking the belt 14. Such buckle 22 is exteriorly fixed to the box-like body 17. The operation of the buckle 22 is well-known to the skilled person.

In operation, the user may use the crib 1 as a normal crib, i.e. separate from the bed 100. In order to place the crib adjacent to the bed 100, the user opens the front side la of the crib 1. Then, the support structure 6 is adjusted such that the moving side 4*c* of the upper portion 4 will be at substantially the same height as the mattress of the bed 100. The user unwinds each belt 14 and wraps it around a fixed portion of the bed 100, as shown for example in FIG. 3. Thus, each belt 14 is locked in its respective buckle. According to one embodiment, the user may press the lock button 19 to lock the belt 14. Thus, the crib 1 is adapted to be used with the bed 100.

The crib 1 will be released from the bed 100 by simply releasing the belts 14 from the buckles and, if the lock/unlock members have been previously operated, by pressing the unlock button 20. Thus the rollers 15 will be biased by the elastic torque of the springs 16 and each will rewind its belt 14 in the box-like body 17. The crib 1 will be moved back to the separate mode by simply closing the front side 1*a*.

The invention claimed is:

1. A baby crib, comprising:

a frame comprising an upper portion and a lower portion connected together;

a plurality of peripheral walls made of flexible material and secured to the frame;

a bottom secured to the frame at the lower portion of the frame and surrounded by the peripheral walls;

at least one of the peripheral walls having variable height;

a support structure configured to support the frame and configured to increase and/or decrease a height of the bottom; and elastic return members, fixed to the lower portion of the frame, that are configured to be fixed to a bed to push the frame against the bed;

wherein when the height of the bottom is increased and/or decreased, the upper portion, the lower portion, the elastic return members, and the bottom are rigidly movable jointly with each other, wherein the elastic return members comprise:

at least one winding belt;

at least one roller; and a spring connected to the at least one roller and configured to apply elastic torque to the at least one roller;

wherein the at least one winding belt is configured to be wound around the at least one roller, wherein the frame comprises at least one connection element fixed to the lower portion, and wherein the at least one roller is rotatably connected directly to the at least one connection element.

2. The crib of claim 1, wherein the at least one roller has a substantially vertically-oriented axis of rotation.

3. The crib of claim 1, wherein the elastic return members further comprise two winding belts and two rollers, wherein each of the winding belts is configured to be wound on a respective one of the rollers, and wherein the rollers are rotatably connected to the frame at a respective side, the sides being opposite to each other.

4. The crib of claim 1, wherein the lower portion comprises a pair of first sides, opposite to each other, wherein each of the first sides is connected to a pair of second sides, and wherein the second sides are longer than the first sides.

5. The crib of claim 1, further comprising:

at least one body having a slot;

wherein the at least one roller is inside the at least one body, and wherein the at least one winding belt extends through the slot.

6. The crib of claim 5, further comprising:

members for locking/unlocking the at least one winding belt;

wherein the members for locking/unlocking are housed within the at least one body.

7. The crib of claim 5, wherein the elastic return members further comprise a buckle configured to lock/unlock the at least one winding belt, and wherein the buckle is fixed to the at least one body.

8. The crib of claim 1, wherein the support structure is further configured to adjust a height of the frame from a floor.

9. The crib of claim 1, wherein the support structure is further configured to adjust a height of the frame relative to the bed.

10. The crib of claim 1, further comprising:

a mattress configured to fit inside the crib.

11. A baby crib, comprising:

a frame comprising an upper portion and a lower portion connected together;

a plurality of peripheral walls made of flexible material and secured to the frame;

a bottom secured to the frame at the lower portion of the frame and surrounded by the peripheral walls;

at least one of the peripheral walls having variable height;

a support structure configured to support the frame and configured to increase and/or decrease a height of the bottom; and elastic return members, fixed to the lower portion of the frame, that are configured to be fixed to a bed to pull the frame against the bed;

wherein when the height of the bottom is increased and/or decreased, the upper portion, the lower portion, the elastic return members, and the bottom are rigidly movable jointly with each other, wherein the elastic return members comprise:

at least one winding belt;

at least one roller; and a spring connected to the at least one roller and configured to apply elastic torque to the at least one roller;

wherein the at least one winding belt is configured to be wound around the at least one roller, wherein the frame comprises at least one connection element fixed to the lower portion, and wherein the at least one roller is rotatably connected directly to the at least one connection element.

12. The crib of claim 11, wherein the at least one roller has a substantially vertically-oriented axis of rotation.

13. The crib of claim 11, wherein the elastic return members further comprise two winding belts and two rollers, wherein each of the winding belts is configured to be wound on a respective one of the rollers, and wherein the rollers are rotatably connected to the frame at a respective side, the sides being opposite to each other.

14. The crib of claim 11, wherein the lower portion comprises a pair of first sides, opposite to each other, wherein each of the first sides is connected to a pair of second sides, and wherein the second sides are longer than the first sides.

15. The crib of claim 11, further comprising:

at least one body having a slot;

wherein the at least one roller is inside the at least one body, and wherein the at least one winding belt extends through the slot.

16. The crib of claim 15, further comprising:

members for locking/unlocking the at least one winding belt;

wherein the members for locking/unlocking are housed within the at least one body.

17. The crib of claim 15, wherein the elastic return members further comprise a buckle configured to lock/unlock the at least one winding belt, and wherein the buckle is fixed to the at least one body.

18. The crib of claim 11, wherein the support structure is further configured to adjust a height of the frame from a floor.

19. The crib of claim 11, wherein the support structure is further configured to adjust a height of the frame relative to the bed.

20. The crib of claim 11, further comprising:

a mattress configured to fit inside the crib.

* * * * *